US008240431B2

(12) United States Patent
Smith

(10) Patent No.: US 8,240,431 B2
(45) Date of Patent: Aug. 14, 2012

(54) APPARATUS FOR ARRESTING A FALL

(76) Inventor: Brent Smith, Weston, MO (US)

( * ) Notice: Subject to any disclaimer, the term of this patent is extended or adjusted under 35 U.S.C. 154(b) by 1112 days.

(21) Appl. No.: 11/605,599

(22) Filed: Nov. 28, 2006

(65) Prior Publication Data

US 2007/0289811 A1 Dec. 20, 2007

Related U.S. Application Data

(60) Provisional application No. 60/814,121, filed on Jun. 16, 2006.

(51) Int. Cl.
*A62B 35/00* (2006.01)

(52) U.S. Cl. ..... 182/3; 182/45; 482/15; 482/45; 52/155

(58) Field of Classification Search ..... 52/155–166; 482/45, 15; 182/45, 3
See application file for complete search history.

(56) References Cited

U.S. PATENT DOCUMENTS

| | | | | | |
|---|---|---|---|---|---|
| 742,279 | A | * | 10/1903 | Bearse | 52/162 |
| 1,676,197 | A | * | 7/1928 | Marrinan | 52/156 |
| 1,982,963 | A | * | 12/1934 | Post | 52/162 |
| 2,707,585 | A | | 5/1955 | Hoey | |
| 3,003,579 | A | | 10/1961 | Weiss | |
| 3,747,552 | A | * | 7/1973 | Rhodes | 114/295 |
| 4,174,021 | A | | 11/1979 | Barlock | |
| 4,213,624 | A | | 7/1980 | Sanders | |
| 4,274,507 | A | | 6/1981 | Williams | |
| 4,315,387 | A | * | 2/1982 | Lee et al. | 52/156 |
| 4,458,617 | A | * | 7/1984 | Eden | 114/39.16 |
| 4,496,027 | A | | 1/1985 | Fisher | |
| 4,607,724 | A | * | 8/1986 | Hillberg | 182/3 |
| 4,644,712 | A | * | 2/1987 | Watson | 52/162 |
| 4,799,840 | A | | 1/1989 | Van Gompel et al. | |
| 4,801,228 | A | | 1/1989 | Van Gompel | |
| 4,817,758 | A | | 4/1989 | Gilmore | |
| 5,004,072 | A | * | 4/1991 | Launer | 182/45 |
| 5,065,838 | A | | 11/1991 | Finley | |
| 5,135,078 | A | * | 8/1992 | Bell et al. | 182/142 |
| 5,328,192 | A | | 7/1994 | Thompson | |
| 5,337,856 | A | | 8/1994 | Fillers | |
| 5,370,203 | A | | 12/1994 | Kiska | |
| 5,476,282 | A | | 12/1995 | Dahl | |
| 5,820,143 | A | | 10/1998 | Rigo | |
| 6,019,330 | A | * | 2/2000 | Affrunti | 248/237 |
| 6,227,553 | B1 | * | 5/2001 | Palmer | 280/47.18 |
| 6,412,230 | B1 | * | 7/2002 | Zambelli et al. | 52/27 |
| 6,880,838 | B2 | | 4/2005 | Hjorth | |
| 7,032,710 | B2 | * | 4/2006 | Anderson et al. | 182/16 |
| 7,207,414 | B2 | * | 4/2007 | Luke et al. | 182/3 |
| 2004/0055818 | A1 | * | 3/2004 | Fulton et al. | 182/3 |
| 2004/0195041 | A1 | * | 10/2004 | Vetesnik | 182/3 |
| 2006/0107605 | A1 | * | 5/2006 | Krahn | 52/155 |
| 2007/0289811 | A1 | * | 12/2007 | Smith | 182/3 |

FOREIGN PATENT DOCUMENTS

| | | |
|---|---|---|
| WO | WO 93/12838 | 7/1993 |
| WO | WO 03/080186 | 10/2003 |
| WO | WO 2004/028326 | 4/2004 |
| WO | WO 2004/103473 | 12/2004 |
| WO | WO 2005/065191 | 7/2005 |

* cited by examiner

*Primary Examiner* — Katherine W Mitchell
*Assistant Examiner* — Candace L Bradford
(74) *Attorney, Agent, or Firm* — Jacob & Associates, LLC

(57) ABSTRACT

A roofing worker safety device is provided that delivers a resistive force in response to a worker falling from an elevated work surface such as a roof via a safety cable connecting the worker to the safety device, the cable transmitting the force of the falling worker to the device to activate an arrestor arm that is forced into the surface on which the safety device is placed thereby stopping the fall of a worker from the roof.

9 Claims, 8 Drawing Sheets

APPARATUS FOR ARRESTING A FALL

This application claims benefit of U.S. Provisional Application, Ser. No. 60/814,121 filed Jun. 16, 2006.

FIELD OF THE INVENTION

The present invention relates to fall arresting safety devices generally, and in particular, to a safety device which may be used adjacent a precipice such as a flat roof surface or an upper story of a multi-story building being constructed that has no exterior wall or on the ground adjacent a shaft or well or other precipice. In one typical situation the present invention can be used by roofers and roof repair workers to allow the workers to attach a safety cable to the safety device to allow the workers to move freely about a building roof surface but to provide a resistance to a sudden fall from the roof by a worker to prevent the worker from falling to the ground. In this same manner the device can be used by workers during the construction of a multi-story building prior to the installation of exterior walls or by workers on the ground adjacent a shaft or well or other precipice.

SUMMARY OF THE INVENTION

The fall arrestor assembly comprises an arrestor arm having a first end pivotally attached to a support and a second end presenting a toothed gripping plate. A cable or tether connects the worker with the second end of the arm. During normal worker activity the arm is held above the surface, such as a roof, on which the support has been placed by a gas filled cylinder that provides just sufficient pressure to maintain the arm and gripping plate spaced from the surface. Upon a worker beginning to fall from the roof, the tether exerts a pull or a pulling force against the arm having the gripping plate connected thereto. The pulling force is directly proportional to the weight of the worker and the velocity of the worker's fall. This pulling force overcomes the pressure of the gas filled cylinder and allows the pulling force generated by the falling worker to jamb the gripping plate into the surface to provide a resistance to terminate the fall of the worker.

In a typical embodiment, the arrestor arm is mounted on a wheeled cart which acts as the support. The cart is intended for use on a roof top and is provided with large rubber wheels so the cart may hold and transport a variety of roofer repair equipment about the roof work area while also providing emergency fall arresting capabilities for the workers who are atop the roof. An embodiment of simplest form, comprises a wheeled cart having the fall arrestor arm mounted thereon with tether or safety cable attachment points to allow workers to attach safety cables to the fall arrestor with the second end of the safety cable attached to the worker.

It will be appreciated that the wheeled cart allows the arrestor arm to be mobile and to be situated easily and quickly wherever the workers are located. Typically, the work site will be a generally flat roof of a large building upon which the cart holding the arrestor arm can be placed.

Therefore, it is an object of the to provide an easily mobile fall safety arrestor which may be used by one or more roofing repair workers while at the top of a building for repairing the roof thereof.

DESCRIPTION OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims.

DETAILED DESCRIPTION

As required, detailed embodiments of the present inventions are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
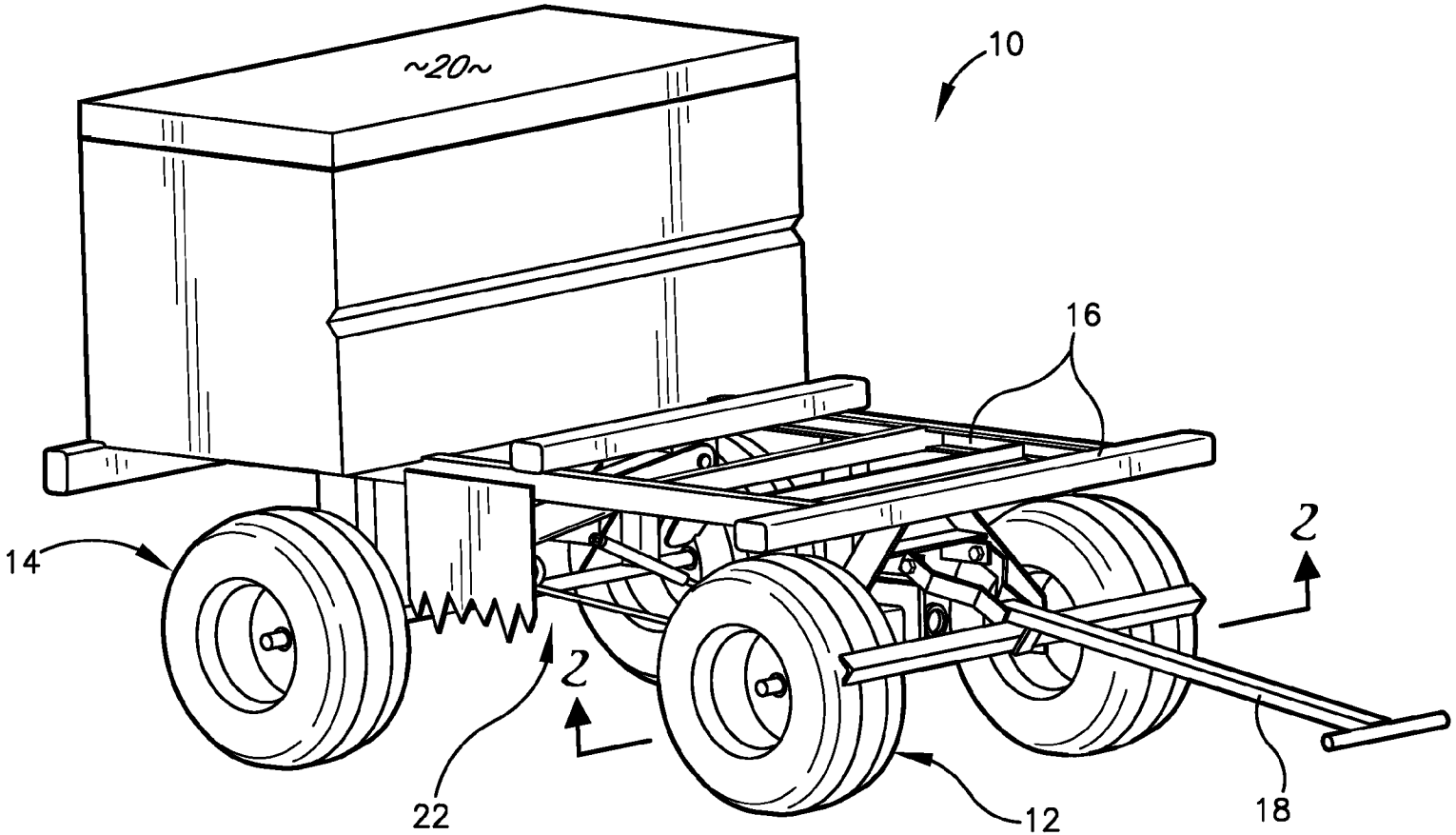
FIG. 1 is a front and left side perspective view of an embodiment mounted on a wheeled cart having a utility box on top of the cart.

Referring now to FIG. 1, a perspective view of an embodiment is shown. Safety vehicle 10 generally comprises a wheeled cart having front and rear assemblies 12, 14 with a steel superstructure 16 mounted therebetween and a tongue or handle 18 attached to front wheel assembly 12. While not a requirement of use, additional weight may be added to the embodiment to increase safety by adding devices such as a utility box 20 to the top of superstructure 16. Also, a generator (not shown) could be added to the top of superstructure 16. It will be appreciated by those skilled in the art that safety vehicle 10 is intended to operate without any additional material added onto superstructure 16, and that the weight and operational features of safety vehicle 10 are sufficient in and of themselves to provide the needed fall arresting capabilities which safety vehicle 10 is intended to provide. It will further be appreciated that while the arrestor arm could operate while attached to a fixed or immobile support, having the arrestor arm attached to a mobile support such as vehicle 10 enhances the ease of use of the arrestor arm.

Figure 2:
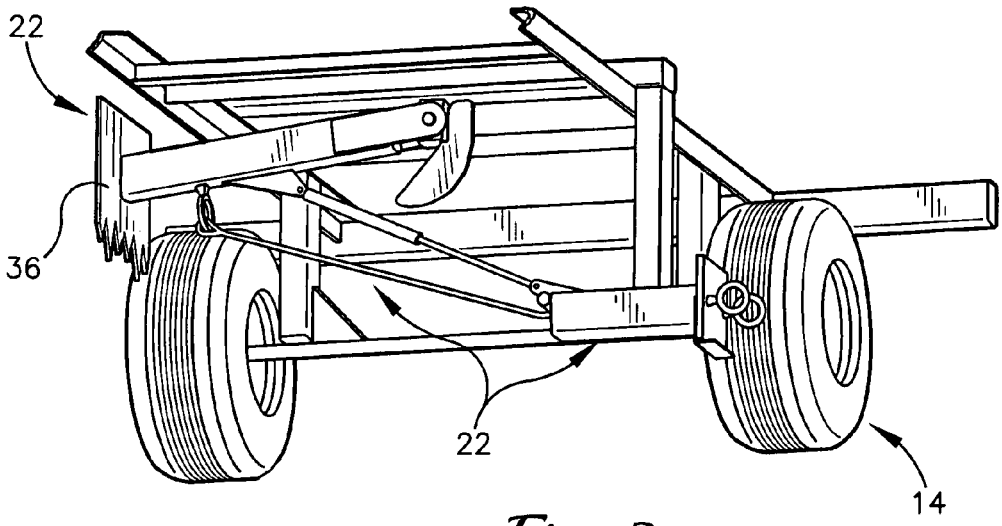
FIG. 2 is a cross section view taken along line 2-2 of FIG. 1 and showing the arrestor arm in the supported position.

Referring to FIG. 2, fall arrestor assembly 22 is shown positioned between front and rear wheel assemblies 12, 14 with front wheel assembly and the front portion of safety vehicle 10 removed for clarity. In FIG. 2 the general manner a affixing arrestor assembly 22 to a support structure is shown with the arrestor assembly 22 being mounted to vehicle 10 so assembly 22 is clear of wheel assemblies 12, 14 and is provided with a clear and unobstructed downward path to allow engagement or gripping plate 36 to contact the surface upon which the cart or vehicle 10 is positioned. In general, the attachment of fall arrestor 22 to superstructure 16 is by welding with the intent being to make arrestor assembly 22 an integral part of vehicle 10.

Figure 3:
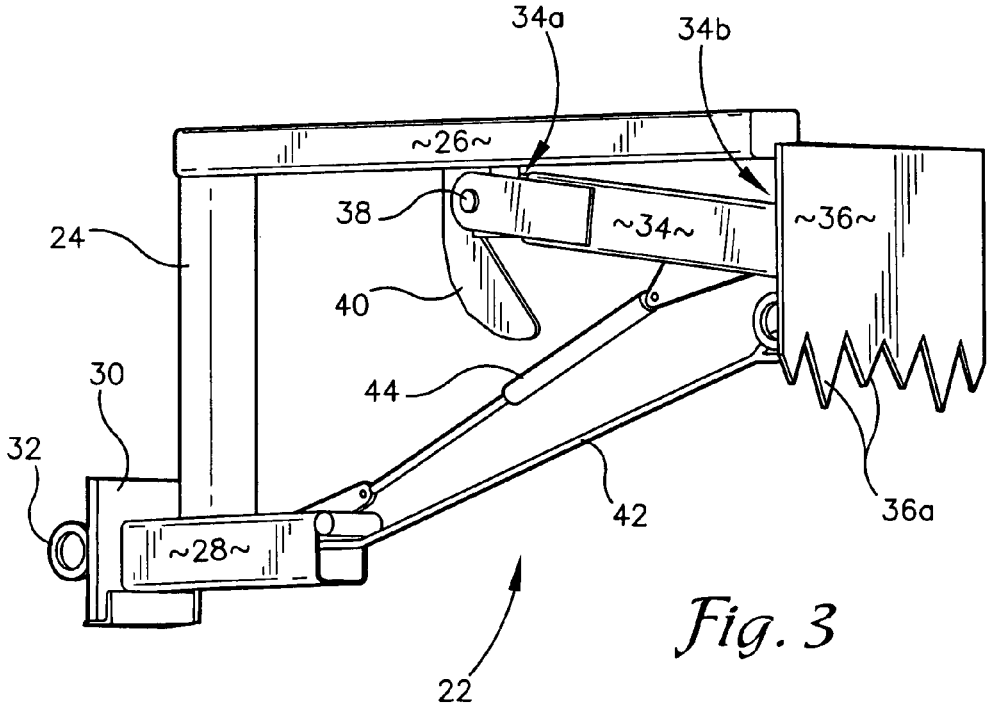
FIG. 3 is a left side and rear perspective view of the arrestor arm removed from the support structure of the cart and showing the arrestor arm in the supported position.

Referring now to FIG. 3, the construction arrestor assembly 22 will be described. Arrestor assembly 22, in its most basic form, is comprised of an arm which pivots at a first end and which is provided with a means for gripping or gouging into or securing itself to a roof or other resilient structure upon which arrestor assembly 22 is positioned above. A cable from the worker is connected to the end of the arm adjacent to the gripping plate to thereby cause a response of the arrestor assembly 22 if the worker exerts a sudden velocity on the cable such as occurs in a fall, the response is the rapid pivoting of the arm downwardly in response to the force of the falling worker. The force of the worker's fall is transmitted through the cable and causes the gripping plate to pivot downwardly and be thrust into the surface above which arrestor assembly 22 is mounted thereby providing a resistance to further falling of the worker. Specifically, as shown in FIG. 3, arrestor assembly 22 is comprised of arrestor arm 34 having a first end 34*a* which is pivotally mounted by pivot pin 38 on securing plate 40 which extends from horizontal member 26. A second end 34*b* of arm 34 is provided with gripping plate or engagement plate 36 having teeth 36*a* extending on a lower edge of engagement plate 36. It will be appreciated that engagement plate 36 may, alternatively, be comprised of a generally blunt edge or blunt engagement projection surface in a substitute embodiment with respect to teeth 36*a*. Depending on the type of surface on which the arrestor assembly 22 is used, alternative surface engaging portions on engagement plate 36 may be preferred to teeth 36*a*. Such a substitution is a matter of choice for those skilled in the art.

It will be generally appreciated that arm 34 is held in an upward position which is out of contact with any surface, such as a roof, upon which vehicle 10 is positioned. Hereinafter, this upward position in which arm 34 is spaced away from a roof or other support surface will be referred to as the "disengaged position" of arrestor assembly 22.

Figure 11:
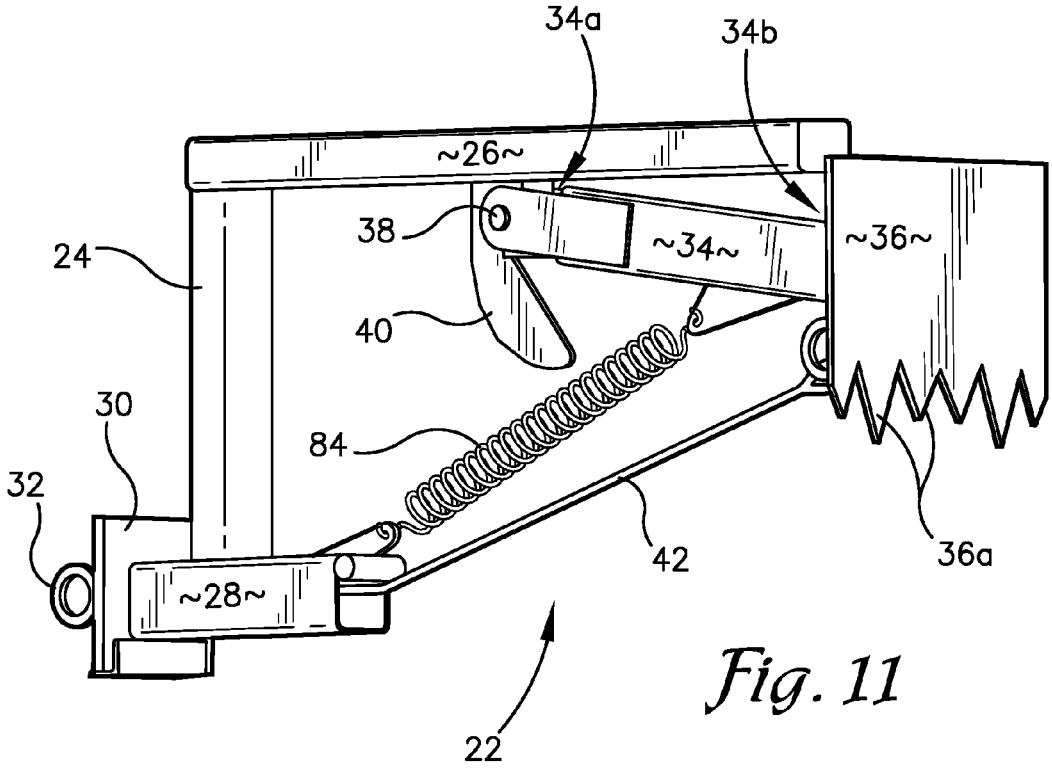
FIG. 11 is a left side and rear perspective view of the arrestor arm removed from the support structure of the cart and showing the arrestor arm in the supported position, wherein the arm support is a spring.

Arrestor arm 34 is held in the disengaged position by arm support 44. Arm support 44 may be comprised of a hydraulic cylinder or a pneumatic cylinder or a spring 84 to bias arm support 44 into the disengaged position (FIGS. 3 and 11). It will be appreciated that arm support 44 connects between arm 34 and any other conveniently located structure to retain arm 34 in the disengaged position. It also will be appreciated that arm 34 could be maintained in place using a sheer pin to retain arm 34 in the disengaged position until the applied force of a falling worker causes the pin to break thereby allowing the arm to move into the engaged position.

As shown in FIG. 3, arm support 44 connects between arm 34 and cable tunnel or cable throat 28. The movement of arm 34 between the upward, or disengaged position, and the downward or engaged position (FIGS. 3 and 4) is effected by connector cable 42. Connector cable 42 is connected to an area of arm 34 that is adjacent arm second end 34*b*. This connection may be on or adjacent to engagement plate 36. A second end of connector cable 42 is attached to connector plate 30. On an opposite side of connector plate 30 from the point of attachment of connector cable 42 are connection eyes 32 to which a worker can affix the safety line which is attached to the worker. While the operation of arrestor assembly 22 will be described in greater detail hereinafter, it will be appreciated that, generally, the force of a falling worker or falling body which is exerted against connection eye 32 is transmitted via connector plate 30 to connector cable 42 and this force overcomes the resistance of arm support 44 and causes arm 34 to pivot toward the engaged position to force engagement plate teeth 36*a* into the surface upon which vehicle 10 and arrestor assembly 22 are positioned. The gripping of engagement plate 36 in the surface terminates the pivotal movement of arm 34 and provides a resistance against further falling of the worker connected to arrestor assembly 22 by connection eye 32.

Figure 4:
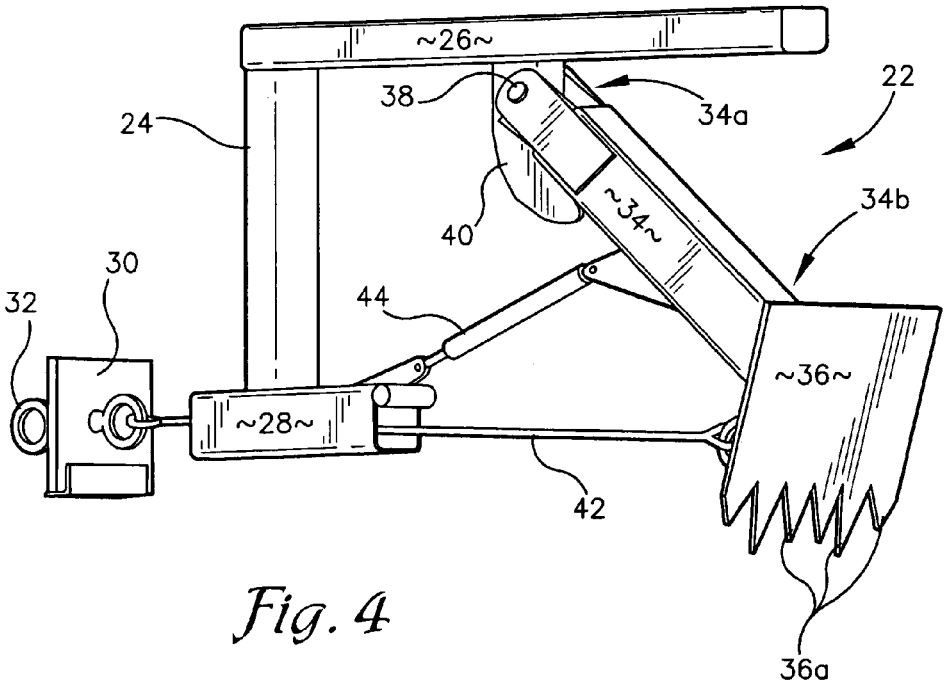
FIG. 4 shows the arrestor arm of FIG. 3 in the lowered position for terminating a worker fall by digging into the roof or surface on which the cart of FIG. 1 is positioned.

Referring now to FIGS. 3 and 4, the attachment of fall arrestor assembly 22 and the parts making up fall arrestor assembly 22 will be described. First referring to FIG. 3, it may be seen that fall arrestor assembly 22 is connected to a vertical member 24 and horizontal member 26. Vertical member 24 and horizontal member 26 are used to mount the fall arrestor assembly 22 onto vehicle 10. It will be appreciated by those skilled in the art that vertical member 24 and horizontal member 26 can be a part of vehicle 10 or, where arrestor assembly 22 is manufactured as a separate unit for mounting on a structure supplied by another, vertical member 24 and horizontal member 26 can be incorporated into the construction of arrestor assembly 22 to permit manufacture of a complete arrestor assembly that can be integrated into a pre-existing vehicle of a consumer.

Attached to horizontal member 26 is arrestor arm 34 having engagement plate 36 attached thereto. Arrestor arm 34 is pivotally connected to horizontal member 26 by pivot pin or attachment pin 38 which connects arrestor arm 34 to securing plate 40 which is attached to horizontal member 26. Vertical member 24 has a first end connected to horizontal member 26 and has an opposite end connected to cable tunnel or throat 28. Connector cable 42 passes to connect engagement plate 36 with cable connector plate 30 which is positioned against the opposite end of cable tunnel 28 from the entrance end for connector cable 42. It will be appreciated by those skilled in the art that it is necessary that arrestor arm 34 having engagement plate 36 thereon be retained in an upward position to avoid dragging and to provide a spaced relation to a roof top or other surface. This spacing is accomplished by the use of arm support 44 which, in one embodiment, is a gas cylinder. Arm support 44 provides sufficient resistance to maintain arrestor arm 34 and roof engagement plate 36 in an upward, unengaged position with respect to a roof surface. Attached to cable connector plate 30 is eye 32 which allows convenient attachment of worker safety cables to fall arrestor assembly 22.

The two operational positions of fall arrestor assembly 22, unengaged and engaged, are shown in FIGS. 3 and 4 respectively. In FIG. 3, fall arrestor assembly 22 is in the upward or unengaged position. In FIG. 4, fall arrestor assembly 22 is in the engaged position in which arm 34 has pivoted to bring engagement plate 36 forcefully into contact with a roof surface so that teeth 36*a* bite into the roof surface. Typically, arrestor assembly 22 will be in the position shown in FIG. 3 as it does not engage with the roof or building surface at any time other than when a worker has fallen from the roof of a building.

Figure 5:
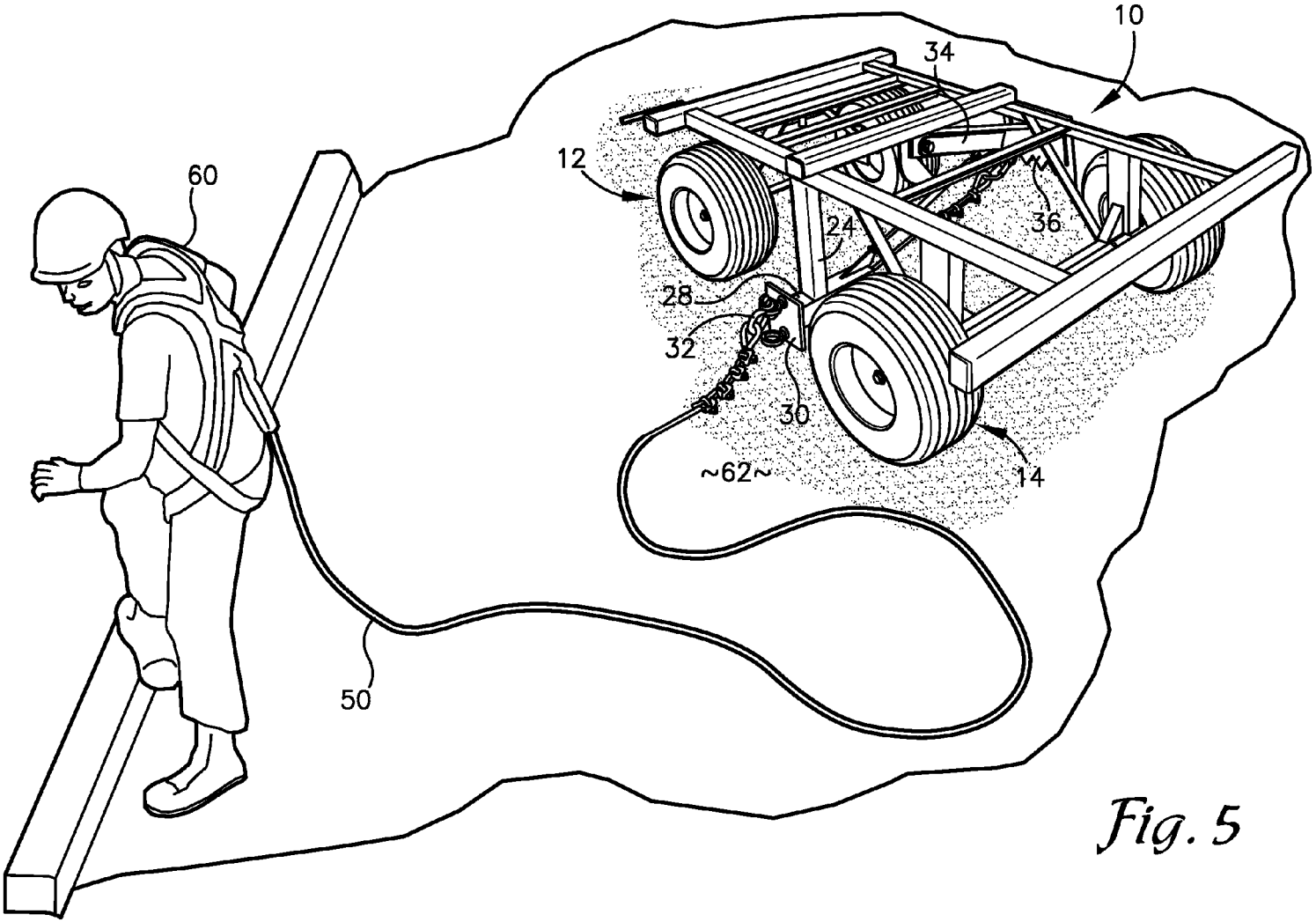
FIG. 5 is a rear and right side perspective view of an embodiment with a worker tethered to the fall arrestor and the fall arrestor in the raised or supported position with the fall arrestor attached to a cart on a roof top.
Figure 6:
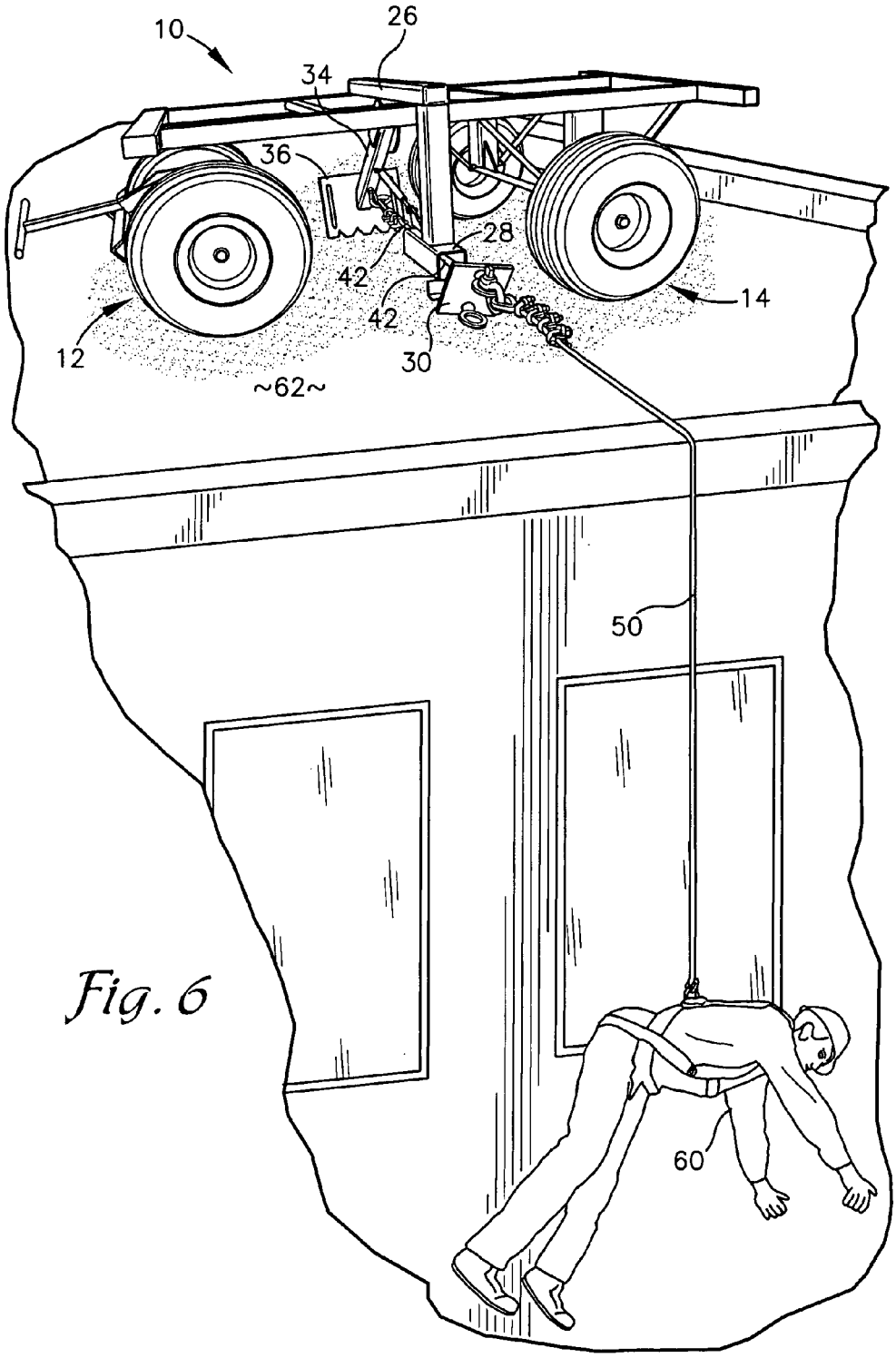
FIG. 6 is a side view of the embodiment of FIG. 5 showing the worker tethered to the fall arrestor after a fall from the roof and the fall arrestor in the lowered or engaged position and inserted into the roof to stop the fall or the worker.

Now referring to FIGS. 5 and 6, an embodiment 10 is shown having a worker safety cable 50 attached to eye 32 of cable connection plate 30. In FIG. 5, arrestor arm assembly 22 is shown in the upward or unengaged position as a worker 60 walks about on a roof 62 of a structure. It will be appreciated that roof 62 will typically be a large work area and that the mounting of arrestor arm assembly 22 on vehicle 10 provides a great benefit to its use in both mobility of the arrestor arm assembly 22 about the roof 62 and in ease of use of the device. The present arrestor assembly is very easy for workers to use as it only require repositioning of vehicle 10 from one work area to another on roof 62. The present arrestor assembly does not require any lengthy setup or break down for it use. A worker 60 need only position vehicle 10 near the work site and attach the safety cable 50 to eye 32. This ease of operation is substantially different from prior art devices requiring use of counter weight structures that must be assembled and disassembled.

Again, referring to FIG. 5, the fall arrestor assembly 22, is shown having roof engagement plate 36 thereon. Arm support 44 holds arm 34 in the upward position during normal work conditions as fall arrestor assembly 22 has not been activated by the fall of an employee 60 from the roof 62 which would cause a forceful downward pull on arrestor arm 34 by safety cable 50 connected to connector cable 42.

Referring now to FIG. 6, the engagement of fall arrestor assembly 22 during the course of stopping or arresting the fall of a worker 60 from the roof 62 of a building is shown. In FIG. 6, after a worker 60 has fallen from the roof 62, worker safety cable 50 has transmitted the force of the worker's fall and has pulled arm 34 of fall arrestor assembly 22 downwardly due to the weight of the fallen worker pulling on worker safety cable 50. This force from the fall of the worker is transmitted to eye 32 to which worker safety cable 50 is attached. Eye 32, being attached to cable connector plate 30, transmits the load of the worker's fall through worker safety cable 50 to connector cable 42 which is attached to cable connector plate 30. Connector plate 30 then passes this force through cable tunnel 28 to transmit the force of the worker's fall to arrestor arm 34. The force transmitted along worker safety cable 50 through eye 32 and to cable plate 30 and then to connector cable 42 reaches arrestor arm 34 and causes a downward force on arrestor arm 34 which pivots downwardly and causes engagement plate 36 to strike roof 62. It will be appreciated that prongs 36*a* on roof engagement plate 36 are forced into roof 62 thereby adding additional resistance, beyond the weight of vehicle 10 and arrestor assembly 22, against the pulling force of the worker's weight on worker safety cable 50. It further will be appreciated that the previously described force traveling along worker safety cable 50 to arrestor arm 34 overcomes the upward supporting force of arm support 44 to allow arrestor arm 34 to pivot downwardly about attachment pin 38 which secures arrestor arm 34 to securing plate 40 of horizontal member 26.

Still referring now to FIG. 6, the various operational connections that are employed to bring fall arrestor assembly 22 into action to prevent a complete fall of a worker to the ground will be described. Superstructure 16 is shown supporting fall arrestor assembly 22 thereon with horizontal member 26 placed laterally across superstructure 16 and with vertical member 24 extending from horizontal member 26 and with cable tunnel 28 attached to vertical member 24. As previously described, worker safety cable 50 is attached to eye 32 which is connected to cable connection plate 30 to which is attached cable connector 42 which extends through cable tunnel 28 to connect with arrestor arm 34 having roof engagement plate thereon. As a result of the weight and force provided by the falling worker on worker safety cable 50, this force is transmitted through the connections previously described to arrestor arm 34 which is forced downwardly and into roof 62 as arrestor arm 34 pivots on attachment pin 38 which connects arm 34 to securing plate 40 which is attached to horizontal member 26. In this manner, arrestor arm assembly 22 of safety vehicle 10 becomes securely attached to roof 62 to prevent the fall of the worker for any greater distance than it is allowed by the length of worker safety cable 50.

Still referring to FIG. 6, it will be further appreciated that a plurality of eyes 32 may be provided on cable connector plate 30 to permit multiple worker safety cables 50 to be attached to safety vehicle 10.

Figure 7:
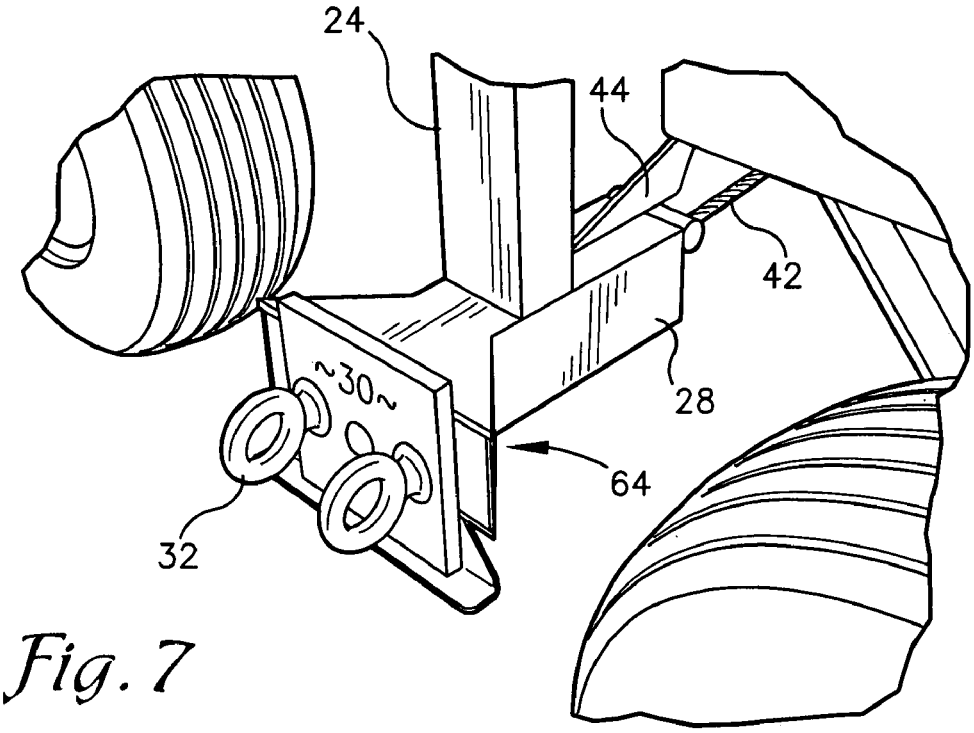
FIG. 7 is a front and side fragmentary view of the throat guide showing an alternative embodiment of the throat guide having a wide mouth to avoid any interference of the throat guide with movement of the cable when a worker is positioned at nearly a ninety degree angle to the throat guide and the arrestor arm.
Figure 8:
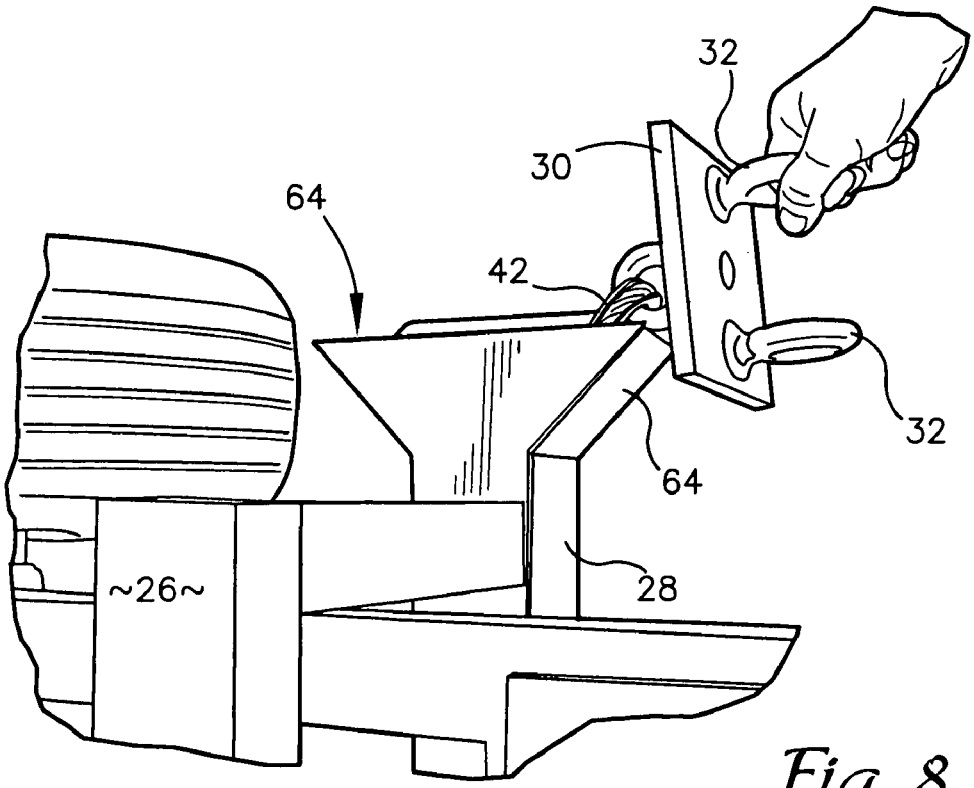
FIG. 8 is a top view of the throat guide showing the securing plate being pulled to nearly a ninety degree angle with respect to the throat guide as could happen when a worker is working at an angle to the arrestor.

Referring now to FIG. 7, a variation in the configuration of cable tunnel or cable throat 28 will be described. An examination of the cable throat 28 of FIG. 3 shows an embodiment of the cable throat in which the cable throat is essentially a rectangular tube which is squared off on either end. In FIG. 7, a variation of the cable throat is shown in which the end of the cable throat 28 which contacts connector plate 30 is widened into a mouth-like structure having side walls which are angled outwardly at approximately 45 degrees to the side wall of cable throat 28. The benefit of the addition of a mouth 64 to cable throat 28 is that an impediment to free cable movement is eliminated. Such an impediment to free cable movement can occur when a worker positions himself at an angle of 45 degrees or greater angle with respect to the side wall of cable throat 28. In a configuration such as is shown in FIG. 3 wherein cable throat 28 alone carries connector cable 42, it is possible for a worker who has improperly moved to an angle of greater than 45 degrees with respect to cable throat 28 to cause a slight slowing down of response of arrestor arm 34 due to this improper positioning of the worker on the rooftop with respect to cable throat 28. The inclusion of mouth 64 at the end of cable throat 28 reduces or eliminates any potential for slowing of the response through friction of arrestor arm 34. In FIG. 8, it is shown that as connector plate 30 is pulled to one side of cable throat 28 mouth 64 allows connector plate 30 to be positioned at nearly a ninety degree angle while maintaining connector cable 42 within mouth 64 and cable tunnel 28 and in an unimpeded position to allow an immediate response by arrestor arm 34 to any sudden force that is placed on connector cable 42 by the force of the fall of a worker being transmitted to eye 32 and connector plate 30.

Figure 9:
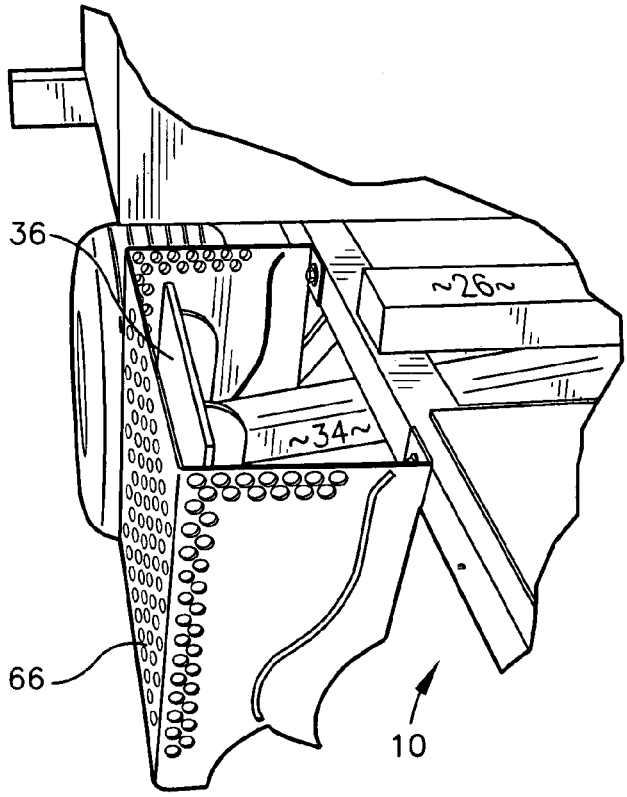
FIG. 9 is a front and left side view of a guard which may be used to surround the gripping plate to prevent objects from impeding the operation of the gripping plate.

Referring now to FIG. 9, a guard for engagement plate 36 is shown. Guard 66 spaces workers and equipment from engagement plate 36 thereby avoiding a circumstance in which materials or equipment or body parts of a person come in contact with engagement plate 36 or arm 34 thereby encumbering the efficient operation of arm 34 and engagement plate 36. It will be appreciated that guard 66 need not extend fully to the ground as engagement plate 36 will travel in an arc which moves inwardly toward the center of vehicle 10. Therefore, if the foot of a worker, for example, were to extend slightly underneath guard 66, the movement of engagement plate 36 in an inwardly directed arc would not contact the worker's foot.

Figure 10:
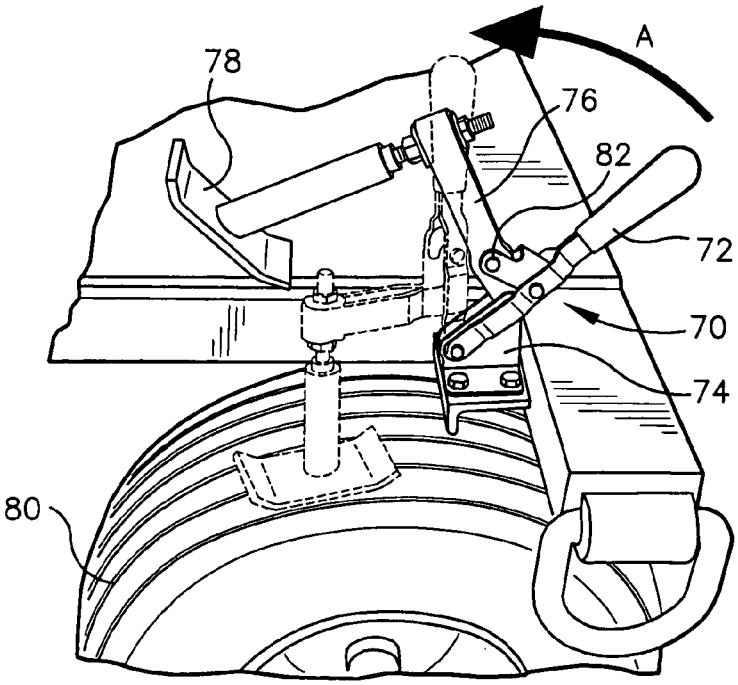
FIG. 10 shows a wheel lock which may be used to prevent movement of a cart that is used to support the arrestor arm and showing the wheel lock in the wheel released position and showing in phantom lines the wheel lock in the engaged or wheel locked position.

Referring now to FIG. 10, a wheel lock device for use on vehicle 10 is shown. Wheel lock 70 is comprised of handle 72 which is pivotally connected to mounting bracket 74. Arm 76 extends from handle 72 at generally a right angle, and arm 76 is pivotally mounted to handle 72. On the unmounted end of arm 76 is clamp 78 which can be fixed and locked against wheel 80 by pressing handle 72 in the direction of arrow A to bring clamp 78 into contact with wheel 80. The pressure of arm 72 against clamp 78 and wheel 80 causes arm 76 to pivot on shaft 82 and to lock arm 76 into a fixed position holding clamp 78 against wheel 80 thereby preventing movement of wheel 80. It will be appreciated by those skilled in the art that these clamping wheel locks are quickly accessible and easily released or locked into position thereby, when locked, eliminating any movement of vehicle 10 along a roof top.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Certain changes may be made in embodying the above invention, and in the construction thereof, without departing from the spirit and scope of the invention. It is intended that all matter contained in the above description and shown in the accompanying drawings shall be interpreted as illustrative and not meant in a limiting sense.

Having now described the features, discoveries and principles of the invention, the manner in which the inventive apparatus and method of arresting a fall are constructed and used, the characteristics of the construction, and advantageous, new and useful results obtained; the new and useful structures, devices, elements, arrangements, parts and combinations, are set forth in the appended claims. It is also to be understood that the following claims are intended to cover all of the generic and specific features of the invention herein described, and all statements of the scope of the invention which, as a matter of language, might be said to fall therebetween.

The invention claimed:

1. An apparatus adapted for use on an elevated surface, and for arresting the fall of a person from the surface, the apparatus comprising:

an apparatus support defining lateral and longitudinal extents, an arrestor assembly connected to said apparatus support, and further comprising:

an arrestor arm fully contained within the extents, pivotally mounted to the support at a first end, and presenting a free second end, wherein the arm is shiftable between a raised non-engaged position and a lowered engaged position, and a gravitational moment-force acts upon the arm at the second end, a gripping plate fully contained within the extents, and secured to the second end, wherein the plate is spaced from the surface in the non-engaged position, and bears upon, so as to grip, the surface in the engaged position, a bias member drivenly coupled to the arm and generating a second force greater than the gravitational moment-force, so as to normally retain the second end in the non-engaged position, and a tether configured for connection to said person, connected to the arm, and operable to transmit an additional force to the arm when the person undergoes a fall from the surface, such that the additional and gravitational-moment forces cooperatively overcome the second force and cause the arm to shift to the engaged position, thereby arresting the fall.

2. The apparatus as claimed in claim 1 wherein said bias member includes a spring.

3. The apparatus as claimed in claim 1 wherein said bias member includes a pneumatic cylinder.

4. The apparatus as claimed in claim 1 wherein said bias member includes a hydraulic cylinder.

5. An apparatus for arresting a fall of a person, comprising:

a vehicle having a vehicle structure and tires for placement on a roof surface;

an arrestor assembly connected to the vehicle structure, shiftable between a raised position and a lowered position, and further including, an arrestor arm spaced away from the roof surface in the raised position, the arrestor arm being biased in the raised position by an arm support, and an engagement plate connected to the arrestor arm, the engagement plate being spaced from the roof surface and adjacent to the vehicle structure when in the raised position and the engagement plate engaging the roof surface in the lowered position;

an internal cable defining a first end and a second end, the first end being coupled to the arrestor assembly to communicate a force to the arrestor assembly, wherein the force causes the arm to shift to the lowered position;

a cable passage fixedly connected to the vehicle structure and including an angle mount defining a cross-sectional opening having a maximum diameter through which the internal cable is entrained; and a cable connector member connected to the second end of the internal cable and disposed adjacent the mount opposite the arm, presenting a lateral dimension greater than the diameter, so as to limit cable travel in one-direction and cooperatively define the non-engaged position, and configured for removable attachment to at least one safety cable opposite the internal cable.

6. The apparatus as claimed in claim 5, wherein the angled mount has side walls that are angled at approximately 45 degrees with respect to a side wall of the cable passage.

7. The apparatus as claimed in claim 5, further comprising a cable throat mounted on said support structure, said tether passing therethrough.

8. The apparatus as claimed in claim 7, wherein the cable throat has a mouth with side walls at approximately 45 degrees with respect to a side wall of the cable throat.

9. The apparatus as claimed in claim 5, wherein the engagement plate and the arrestor arm are disposed between each set of adjacent tires and generally beneath the vehicle structure.

* * * * *